US005827559A

United States Patent [19]

Powell

[11] Patent Number: 5,827,559

[45] Date of Patent: Oct. 27, 1998

[54] COOK-IN PACKAGING AND METHODS RELATING THERETO

[75] Inventor: Richard James Powell, Orange, Tex.

[73] Assignee: E. I. du Pont de Nemours and Company, Wilmington, Del.

[21] Appl. No.: 789,908

[22] Filed: Jan. 29, 1997

Related U.S. Application Data

[60] Provisional application No. 60/011,200 Feb. 2, 1996.

[51] Int. Cl. [6] ..... A23B 00/00; B65D 55/00; C12C 3/04

[52] U.S. Cl. ..... 426/412; 426/113; 426/127; 426/129; 426/415; 428/474.4; 428/474.7; 428/515; 428/516; 428/523; 428/35.4; 428/37.7; 428/36.7

[58] Field of Search ..... 426/113, 127, 426/129, 412, 415; 264/22; 204/165; 428/34.9, 35.2, 35.4, 36.6, 36.7, 36.91, 213, 218, 516, 517, 518, 910, 343, 349, 354, 523, 515, 474.4

[56] References Cited

U.S. PATENT DOCUMENTS

| | | | |
|---|---|---|---|
| 3,354,319 | 11/1967 | Rees | 117/122 |
| 4,351,931 | 9/1982 | Armitage | 526/227 |
| 4,911,963 | 3/1990 | Lustig et al. | 428/36.91 |
| 4,999,229 | 3/1991 | Moritani et al. | 428/36.6 |
| 5,028,674 | 7/1991 | Hatch et al. | 526/216 |
| 5,057,593 | 10/1991 | Marshall et al. | 528/271 |
| 5,213,900 | 5/1993 | Friedrich | 428/474.4 |
| 5,328,705 | 7/1994 | Wilhoit et al. | 426/113 |
| 5,407,611 | 4/1995 | Wilhoit et al. | 264/22 |
| 5,462,756 | 10/1995 | Raines et al. | 426/129 |
| 5,562,958 | 10/1996 | Walton et al. | 428/34.9 |
| 5,629,059 | 5/1997 | Desai et al. | 428/34.9 |

FOREIGN PATENT DOCUMENTS

| | | | |
|---|---|---|---|
| 0 432 611 A2 | 12/1990 | European Pat. Off. | A22C 13/00 |
| 0 447 988 A1 | 3/1991 | European Pat. Off. | B32B 27/08 |
| 0 594 918 A1 | 10/1992 | European Pat. Off. | B32B 27/28 |

*Primary Examiner*—Marian C. Knode
*Assistant Examiner*—Datquan Lee
*Attorney, Agent, or Firm*—Craig H. Evans

[57] ABSTRACT

Heat sealable films for packaging food products, particularly in applications where the packaged food product is heated at high temperatures in a hot water bath. The films have a sealant layer containing an acid copolymer. The acid copolymer has a high degree of ethylene crystallinity and therefore an unusually high melting temperature. The sealant layer provides excellent seal strength and excellent adhesion to meat, particularly poultry, even during hot water immersion.

8 Claims, No Drawings

COOK-IN PACKAGING AND METHODS RELATING THERETO

This application claims the benefit of U.S. Provisional Application No. 60/011,200, filed Feb. 2, 1996.

BACKGROUND OF THE INVENTION

1. Field of the Invention

The present invention relates generally to heat sealable films for packaging food products, particularly in applications where the packaged food product is heated to high temperatures in a hot water bath. More specifically, the present invention is directed to an innovative film sealant layer comprising an ethylene acid copolymer having a high degree of ethylene crystallinity; the sealant layer provides excellent seal strength and excellent adhesion to meat, particularly poultry, even during hot water immersion.

2. Discussion of the Prior Art

Broadly speaking, "cook-in" packaging is known. "Cook-in" packaging is intended to mean food packaging material structurally capable of withstanding immersion in a hot water bath, while containing a food product.

Typical cook-in conditions involve water bath temperatures greater than 60° C., particularly about 60° C.–100° C., and immersion for about 1–12 hours.

The cook-in film is typically heat sealed to itself around the food product. Ideally, the heat sealed seams should resist being pulled apart or otherwise leaking, particularly during cook-in conditions. Cook-in packaging should also have adhesion to the food product, thereby restricting "cook-out" or the collection of juices between the surface of the contained food product and the film. The cook-in film should also have an ability to tightly conform to the shape of the food product, such as, by stretching and/or shrinking.

U.S. Pat. No. 5,462,756 to Raines is directed to cook-in meat packaging, comprising a preformed tray and a flexible lid sealed to a rim of the tray. The flexible lid comprises an ethylene/acid copolymer sealant layer to enhance adherence to the meat product. U.S. Pat. No. 5,462,756 fails to teach or suggest the improved ethylene/acid copolymer sealant compositions of the present invention.

SUMMARY OF THE INVENTION

Overview

The present invention is directed to an innovative cook-in film and its method of use. The cook-in film comprises a sealant layer that contacts the food, particularly poultry. The sealant layer has excellent adhesion to poultry, excellent heat-sealing properties to itself and excellent heat-seal integrity under extreme cook-in conditions, that is food product packaged in the film can be immersed in a hot water bath for up to about 12 hours at temperatures above 60° C. and ranging up to about 100° C. or above.

Acid Copolymer

The advantageous performance of the sealant layer is attributable to the presence of a particular type of ethylene/acid copolymer. The acid copolymer of the present invention provides an optimal melting point for (high temperature) cook-in applications, due to a high degree of ethylene crystallinity and minimal short chain branching. The acid copolymer is preferably derived from at least: (1) ethylene; and (2) an alpha-beta unsaturated carboxylic acid having 3–8 carbon atoms or an anhydride derivative thereof Where an anhydride monomer is used, at least a portion of the anhydride moieties should be hydrolyzed to provide free carboxylic acid moieties as part of the final acid copolymer.

Additional monomers can optionally also be incorporated into the acid copolymer, such as, a vinyl monomer, particularly vinyl esters, such as, alkyl acrylates, particularly isobutyl acrylate.

Preferably, the acid copolymer comprises: (1) at least 80 weight percent ethylene; (2) about 2–20 weight percent acrylic acid and/or methacrylic acid, and (3) the balance (0–10 wt %) being other vinyl monomer(s). More preferably, the acid copolymer comprises at least 85 weight percent ethylene and from about 4 to about 15 weight percent acrylic acid and/or methacrylic acid. A preferred acid copolymer comprises a weight ratio (ethylene:acid:other vinyl monomers) of about 80–96:4–20:0–10. The most preferred acid copolymer is a dipolymer of 88–95 wt % ethylene and the balance being substantially acrylic acid and/or methacrylic acid.

The preferred acid copolymers have a melting temperature high enough that a pouch made from the film can sustain cooking temperatures of 90°–100° C. without forming leakers. It should be low enough, however, so that the film remains tacky enough to stick to the food, particularly to poultry. Preferably the melting temperature should be in the range of about 102° C.–113° C., more preferably 104° C.–112° C. and most preferably 105° C.–110° C. To obtain such high melting properties, the acid copolymer should generally have a high degree of ethylene crystallinity and minimal short chain branching.

Acid copolymers may be blends of copolymers having different acid levels and/or melting points, provided that the resulting blend has an average acid level and melting point in the ranges discussed above.

Acid Copolymer Synthesis

To obtain the high crystallinity and minimal short chain branching, the acid copolymers of the present invention are preferably polymerized using a continuous, well-stirred, substantially constant environment autoclave. Such autoclave reactors are well known in the art and need not be further described here. In use however, conventional reaction conditions will tend to cause short chain branching, and the resulting polymerized product will tend to have an unduly low melting temperature for purposes of the present invention.

To reduce unwanted short chain branching (and thereby raise the melt temperature of the acid copolymer to an acceptable range of 102°–113° C.), the acid copolymer synthesis temperature is preferably lowered and/or the synthesis pressure raised, until the melting temperature of the final product is within the desired range of 102°–113° C.

A chain termination agent (i.e., telogen) is preferably used to (upwardly) adjust the melt index. The melt index of the final product is preferably within the range of 0.5 to about 30 grams/10 minutes according to ASTM D-1238 (testing conditions: 190° C. and 2.16 kilograms), more preferably, the melt index is in the range of 1–10. For embodiments of the present invention where the acid copolymer is partially neutralized with a cation (to create an "ionomer"), such neutralization will tend to decrease the melt index of the material, and therefore, the melt index of the polymerized copolymer can be greater than 30 grams/10 minutes, providing the copolymer melt index is thereafter reduced to the desired melt index range through neutralization.

Generally speaking, the polymerization of the comonomers is initiated by a free radical forming compound. Suitable such compounds are known to those skilled in the art and include: 1. di(sec-butyl)peroxy dicarbonate ("PDC"); 2. di-isopropyl peroxy dicarbonate; 3. t-butyl peroxy-2-ethyl hexonate ("PO"); 4. t-butyl peroxy pivilate; 5. t-butyl peroxy acetate ("PA"); and 6. t-butyl peroxy isobutyrate. In the examples, PDC initiator was used in examples 1,2 and 3, and PO or PA initiator was used in the comparative examples; the choice of initiator was primarily based upon the reactor temperature employed. Ordinary skill and experimentation may be necessary in choosing an initiator, depending upon the particular process conditions selected.

Suitable organic solvent systems for the process include methanol, acetone, tertiary butanol, benzene, chlorobenzene and combinations and/or derivatives thereof Other organic solvents could also be used, and ordinary skill and experimentation may be necessary in developing any particular solvent system.

Bulk polymerization can also be used, involving a substantial absence of added solvent, except as necessary to dissolve the initiator. Where the reactants are not sufficiently soluble to allow a single phase polymerization, a suitable comonomer solvent (i.e., methanol or acetone) is preferably added.

Preferably, a primary solvent is used to carry the reagents, and a secondary solvent or cosolvent is also used to assist in maintaining the reaction in a single phase (both the reagents and the reacted species). Certain solvents, such as, methanol and acetone, are also reactive and thereby also are useful as chain terminating agents. At the autoclave reaction zone, a free radical initiator is generally used, and any one of a number of conventional additives can also be used. The proper choice of solvent, cosolvent(s), chain termination agent, free radical initiator and other additives is a function of process conditions, and ordinary skill and experimentation may therefore be necessary in choosing such process components in accordance with the present invention.

In general, synthesis temperatures will range from about 150° C. to about 230° C., and synthesis pressures will range from about 24 to about 40 kpsi or from about 165 to about 276 mega-Pascal ("mPa"). Preferably, the reaction zone is maintained in a substantially steady state.

The acid copolymer synthesis is conventional. Excellent discussions of acid copolymer synthesis are provided in U.S. Pat. No. 4,248,990 to Pieski, U.S. Pat. No. 3,264,272 to Rees, U.S. Pat. No. 3,404,134 to Rees, U.S. Pat. No. 3,355,319 to Rees and U.S. Pat. No. 3,520,861 to Thomson as well as U.S. Pat. No. 5,057,593 to Marshall, et al., and U.S. Pat. No. 5,028,674 to Hatch, et al. (cosolvent patents), which patents are hereby incorporated by reference into this specification.

The high melting acid copolymer can be up to 30% neutralized with a cation, particularly lithium, sodium, zinc or magnesium, more particularly sodium, zinc and magnesium. Wholly or partially neutralized acid copolymers are often called "ionomers". Preferably, the acid copolymer comprises 2–20 wt %, more preferably 4–15 wt %, unneutralized acid functionality. The melt index is preferably between about 0.5 to about 30 g/10 min ASTM D-1238 (testing conditions: 190° C. and 2.16 kilograms), more preferably, 0.7–10 g/10 min and yet more preferably 1–3 g/10 min.

Adhesion to the meat product is attributable to the acid level (higher acid level will generally provide higher adhesion), and such adhesion advantageously reduces the occurrence of juices between the film and the meat product during the cook-in process. "Heat seal creep" is a term used as a measure of capability to reduce seal leakers or failures during the cooking cycle; heat seal creep generally (advantageously) decreases as the melting point of the film increases. Hence a relatively low seal temperature (melting point) in combination with high meat adhesion (high acid content) is generally necessary to provide a leak free initial seal; consequently, there is an optimum range of melt point and acid level for the acid copolymers of the present invention.

U.S. Pat. No. 4,351,931 to Armitage describes an ethylene/(meth)acrylic acid copolymer synthesis. The synthesis of the ethylene/(meth)acrylic acid copolymers of the present invention can be conducted in accordance with U.S. Pat. No. 4,351,931, provided temperature and pressure is adjusted to produce the desired melting point (102°–113° C.). The desired melting point can be approximated according to the following formula (minor adjustments may be necessary):

$$\text{Melting Point}^{1} = 132.7 - 1.1M - 0.138T_r + 0.345P$$

[1] "Melting Point" is preferably in the range of 102°–113° C., more preferably 104°–112° C. and yet more preferably 105°–110° C.

wherein:

"M" is the weight percent of methacrylic acid monomer, or if acrylic acid monomer is used, the weight percent of acrylic acid monomer should additionally be multiplied by 1.19 to give the value for "M".

"$T_r$" is the reaction temperature (°C.).

"P" is the pressure of the reactor in kpsi (1000 pounds/square inch). Kpsi should be multiplied by 6.89 to provide mega-Pascals.

As an example, for a desired melt point of 106° C. with a methylacrylic acid content of 10 weight percent and a synthesis pressure of 30 kspi (206 mPa), the reactor temperature would be approximately 189° C. (a suitable chain terminating agent preferably is also added to bring the melt index of the final product to within 0.5–30 grams/10 minutes ASTM D-1238 (testing conditions: 190° C. and 2.16 kilograms), more preferably 1–10 grams/10 minutes).

Final Film

The final cook-in film can be monolayer or multilayer. Regardless, the film preferably has a sealant layer that will contact the food at least about 4 microns in thickness, and in addition to the above described acid copolymer (and/or ionomer derivative thereof), the sealant layer can comprise antioxidants, release agents, antiblock agents, (polymeric and non-polymeric) filler and other conventional or non-conventional additives. The additional layers, if any, can be any conventional or non-conventional film layer. Film extrusion, including multilayer film extrusion, is well known to those of ordinary skill and need not be described further here.

Cook-In Poultry Applications

The cook-in films of the present invention are preferably wrapped completely around a food product. The most preferred food product is poultry. The sealant layer provides excellent adhesion to the poultry and also has excellent heat sealing properties to itself The film is tightly wrapped around the food product by vacuum wrapping (using conventional vacuum wrapping equipment), shrink wrapping (e.g., by orienting the film during the film manufacturing process and thereafter heating the film, causing it to shrink tightly around the food product) or similar type conventional or non-conventional wrapping methods. The sealant layers are preferably overlapped and heat sealed at a temperature of about 120°–200° C., thereby hermetically sealing the food product within the film. The wrapped food product is then cooked at high temperature (greater than about 60° C.) by immersion in a hot water bath for about an hour or more. Typically temperatures up to about 100° C. or above are used.

DETAILED DESCRIPTION OF THE PREFERRED EMBODIMENT(S)

The polymerization is preferably conducted in a stirred autoclave, agitated at high rates, such as, 250 rpm and higher, to maintain a constant environment. Ethylene, the acid comonomer (which may be dissolved in ethylene or another suitable solvent), and initiator (also dissolved in a suitable solvent) are injected into the autoclave. The agitator is started and the feed is continued until the desired pressure is reached, at which time a discharge valve is opened to maintain the desired pressure.

The temperature of the reactants is then built up to the start-up state by any suitable means, such as for example, by using a heat exchanger along the feed line, or by using internal or external electrical type heaters or the like. At the start-up pressures and temperatures, the reagents exist as a uniform phase. The polymerization reaction occurs when the temperature is reached at which the polymerization initiator begins to generate free radicals at an appreciable rate. The free radicals induce the polymerization of the monomers and since this reaction is exothermic, the temperature is observed to rise.

When the temperature rises in small increments, the initiator should produce free radicals at an increasing rate. Since the polymerization reaction is exothermic, polymerization will then tend to also proceed at an increasing rate. For this reason, a marked temperature surge is generally observed as the reaction starts-up. Once start-up occurs, the application of heat into the reaction mixture and/or feed streams may be discontinued.

Preferably, the reaction temperature is then adjusted, by controlling the rate in which the initiator is injected. The reactor temperature is allowed to build up to the desired temperature. Polymer is isolated. The resulting polymer solution is passed through pressure let-down steps to isolate polymer from the monomers. The isolated polymer can then be cooled to room temperature.

EXAMPLES

The examples 1, 2, and 3 below were polymerized at a temperature 50°–60° C. lower than the comparative examples in order to decrease short chain branching and thereby increase melt point. The actual combination of reactor temperature and pressure one chooses to use can be derived from the melt point equation for the acid level desired. Ethylene and acid comonomer where fed to the reactor as a single stream. About 2.5 mol % acetone was added to this stream as a telogen and to act as a cosolvent to prevent reactor wall fouling. Initiator was injected into this stream just prior to entering the reactor. The acetone cosolvent 10 was not used in the comparative examples. Table I summarizes the acid copolymer obtained from each example. In the case of the ionomers the off-line neutralization is also shown.

TABLE 1

| EXAMPLE | INIT. TYPE | Melt Index[1] | ACID TYPE[2] | cm % ACID[3] | ION TYPE[4] | % NEUT.[5] | MELT POINT[6] °C. | Heat Seal Creep[7] cm/hr @ 100° C. 200 g loa | 500 g load |
|---|---|---|---|---|---|---|---|---|---|
| C-1 | PA | 1.6 | MAA | 12 | Zn | 38 | 96 | 1.3 | 8 |
| C-2 | PO | 1.6 | MAA | 4 | Zn | 63 | 104 | 0.8 | 23 |
| C-3 | PO | 1.5 | MAA | 9 | NONE | 0 | 99 | 0 | 38 |
| 1 | PDC | 1.3 | MAA | 5.9 | NONE | 0 | 110 | 0 | 0 |
| 2 | PDC | 1.4 | AA | 5.8 | NONE | 0 | 110 | 0 | 0 |
| 3 | PDC | 1.5 | AA | 6.9 | NONE | 0 | 108 | 0 | 0 |

NOTES:
[1]dg/min. MELT INDEX TEST: ASTM D-1238 (190° C./2.16 kg.)
[2]MAA = methacrylic acid; AA = acrylic acid
[3]Weight Percent Acid in the Copolymer Prior to Any Neutralization
[4]Zn = zinc
[5]Percent "ion neutralized" acid groups (of the acid copolymer) can be determined by titration
[6]MELT POINT TEST BY ASTM: D-3418 (DSC)

| EXAMPLE | REMARKS |
|---|---|
| C-1 | WORKS WELL FOR COOK-IN HAM AT <75° C. HEAT SEALS LEAK AT >80° C. FOR COOK-IN POULTRY |
| C-2 | POOR POULTRY MEAT ADHESION AND SEALS LEAK SOMEWHAT |
| C-3 | SOME LEAKER PROBLEMS |
| 1 | LOW LEAKERS, FAIR PURGE RETENTION |
| 2 | LOW LEAKERS, FAIR PURGE RETENTION |
| 3 | LOW LEAKERS, GOOD PURGE RETENTION |

What is claimed is:

1. A method of packaging and processing food at high temperatures, comprising:

A) placing a heat sealable film around and in contact with the food, said film having a sealant layer in contact with the food, the sealant layer having a thickness of at least 4 microns, a melt index between about 0.5 and about 30 g/10 min, and a melting point of from about 102° C. to about 104° C., the sealant layer comprising one or more acid copolymers of at least:

i. about 2 to 20 parts by weight alpha-beta unsaturated carboxylic acid having from 3–8 carbon atoms or an anhydride derivative thereof, provided that at least a portion of the anhydride is hydrolyzed to provide at least 2 weight percent free acid in the copolymer; and ii. at least 80 parts by weight ethylene, B) heat sealing the film to itself to hermetically seal the food within the film, and C) cooking the packaged food in an environment having a temperature of about 60° C. or higher.

2. The method of claim 1 wherein the acid copolymer is a copolymer of:

i. about 2 to 20 parts by weight alpha-beta unsaturated carboxylic acid having from 3–8 carbon atoms, and ii. at least 80 parts by weight ethylene.

3. The method in accordance with claim 2, wherein the alpha-beta unsaturated carboxylic acid is a member of the group consisting of acrylic acid, methacrylic acid and combinations thereof.

4. The method in accordance with claim 2, wherein the acid copolymer is no more than 30% neutralized with a cation, and the acid copolymer comprises about 4 to about 15 weight percent unneutralized acid.

5. The method in accordance with claim 4, wherein the acid copolymer is a copolymer of:

i) at least 80 weight percent ethylene;

ii) about 4–20 weight percent acrylic acid or methacrylic acid, and iii) 0–10 weight percent vinyl monomer other than the vinyl monomers of i) and ii)

wherein i), ii) and iii) total 100%.

6. The method in accordance with claim 5, wherein the acid copolymer is a copolymer of 88–95 weight percent ethylene and 5–12 weight percent acrylic acid or methacrylic acid.

7. The method in accordance with claim 6, wherein the melting point of the acid copolymer is in the range of 105°–110° C.

8. The method of claims 1, 2, 3, 4, 5, 6 or 7 wherein the food is poultry.

* * * * *

UNITED STATES PATENT AND TRADEMARK OFFICE

CERTIFICATE OF CORRECTION

PATENT NO. : 5,827,559

DATED : October 27, 1998

INVENTOR(S) : Richard James Powell

It is certified that error appears in the above-identified patent and that said Letters Patent is hereby corrected as shown below:

Column 6, line 57, claim 1, change "30" to --10--.
Column 6, line 58, claim 1, change "102" to --104--.
Column 6, line 59, claim 1, change "104" to --113--.

Signed and Sealed this

Twenty-third Day of February, 1999

*Attest:*

Q. TODD DICKINSON

*Attesting Officer*

*Acting Commissioner of Patents and Trademarks*